US012286254B2

(12) United States Patent
Cere'

(10) Patent No.: US 12,286,254 B2
(45) Date of Patent: Apr. 29, 2025

(54) UNWINDING APPARATUS FOR WRAPPING MACHINE

(71) Applicant: AETNA GROUP S.P.A., Verucchio (IT)

(72) Inventor: Mauro Cere', Verucchio (IT)

(73) Assignee: AETNA GROUP S.P.A, Verucchio (IT)

( * ) Notice: Subject to any disclaimer, the term of this patent is extended or adjusted under 35 U.S.C. 154(b) by 287 days.

(21) Appl. No.: 17/609,183

(22) PCT Filed: May 15, 2020

(86) PCT No.: PCT/IB2020/054627
§ 371 (c)(1),
(2) Date: Nov. 5, 2021

(87) PCT Pub. No.: WO2020/230098
PCT Pub. Date: Nov. 19, 2020

(65) Prior Publication Data

US 2022/0227513 A1 Jul. 21, 2022

(30) Foreign Application Priority Data

May 16, 2019 (IT) ..... 102019000006886

(51) Int. Cl.
*B65B 11/00* (2006.01)
*B65B 11/02* (2006.01)
*B65B 41/16* (2006.01)

(52) U.S. Cl.
CPC ..... *B65B 41/16* (2013.01); *B65B 11/006* (2013.01); *B65B 11/025* (2013.01); *B65B 2011/002* (2013.01)

(58) Field of Classification Search
USPC ..... 53/203
See application file for complete search history.

(56) References Cited

U.S. PATENT DOCUMENTS 4,204,377 A * 5/1980 Lancaster ..... B65B 11/045 53/399
2002/0043053 A1* 4/2002 Trottet ..... B65B 11/045 53/582

(Continued)

FOREIGN PATENT DOCUMENTS

WO 2012/153285 11/2012
WO WO-2012153285 A1 * 11/2012 ..... B65B 11/025

OTHER PUBLICATIONS

International Search Report issued Sep. 30, 2020 in International (PCT) Application No. PCT/IB2020/054627.

*Primary Examiner* — Chinyere J Rushing-Tucker
(74) *Attorney, Agent, or Firm* — Wenderoth, Lind & Ponack, L.L.P.

(57) ABSTRACT

An unwinding apparatus (1) for wrapping machine (100) to wrap with a film (50) a load (30) on a pallet (40), comprising supporting means (2) for supporting a reel (60) of film (50), roller means (3, 4, 7) for unwinding and pre-stretching the film (50) and a guiding roller (6) that can be tilted for reducing a band width of the film (50) and/or deviating it towards the; first driving means (10) for continuously tilting the guiding roller (6) in a plurality of operating positions (P0, P1, P2) along an adjustment stroke; the guiding roller (6) comprises a first end portion (16) rotatably connected to the supporting means (2) and provided with a roll (8) able to roll up a longitudinal lower edge (50*a*) of the film (50) when the guiding roller (6) is tilted to form a longitudinal rolled portion (51).

18 Claims, 7 Drawing Sheets

(56) References Cited

U.S. PATENT DOCUMENTS

| | | | | |
|---|---|---|---|---|
| 2004/0182050 | A1 | 9/2004 | Pieri | |
| 2005/0044812 | A1* | 3/2005 | Lancaster, III | B65B 41/16 53/399 |
| 2011/0179752 | A1 | 7/2011 | Lancaster, III et al. | |
| 2012/0031053 | A1* | 2/2012 | Lancaster, III | B65B 57/04 53/461 |

* cited by examiner

Fig. 3
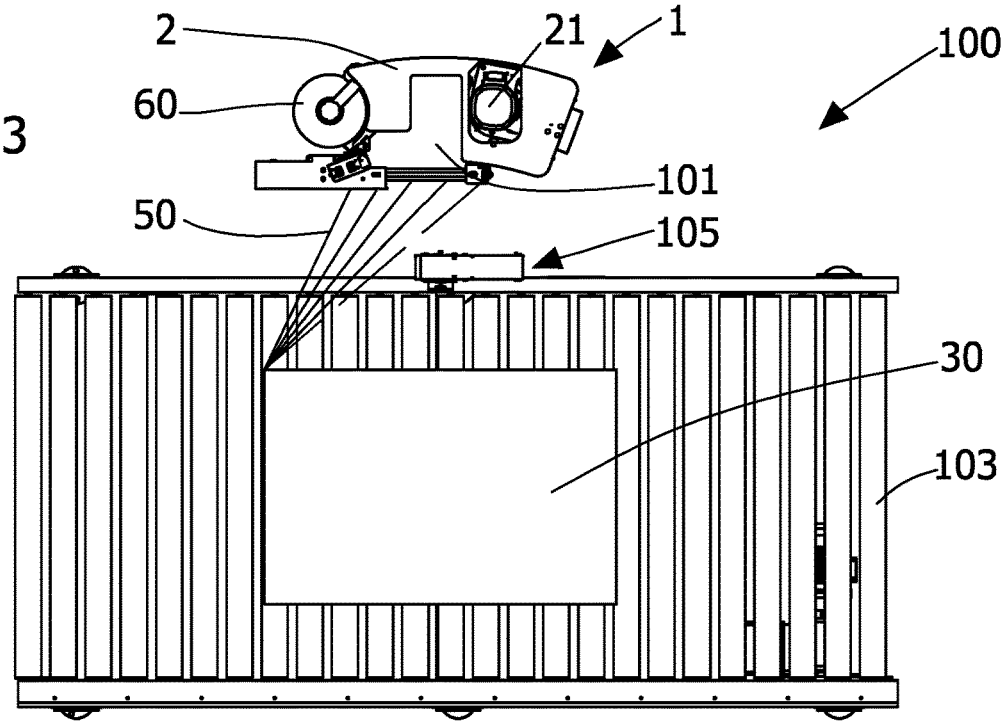
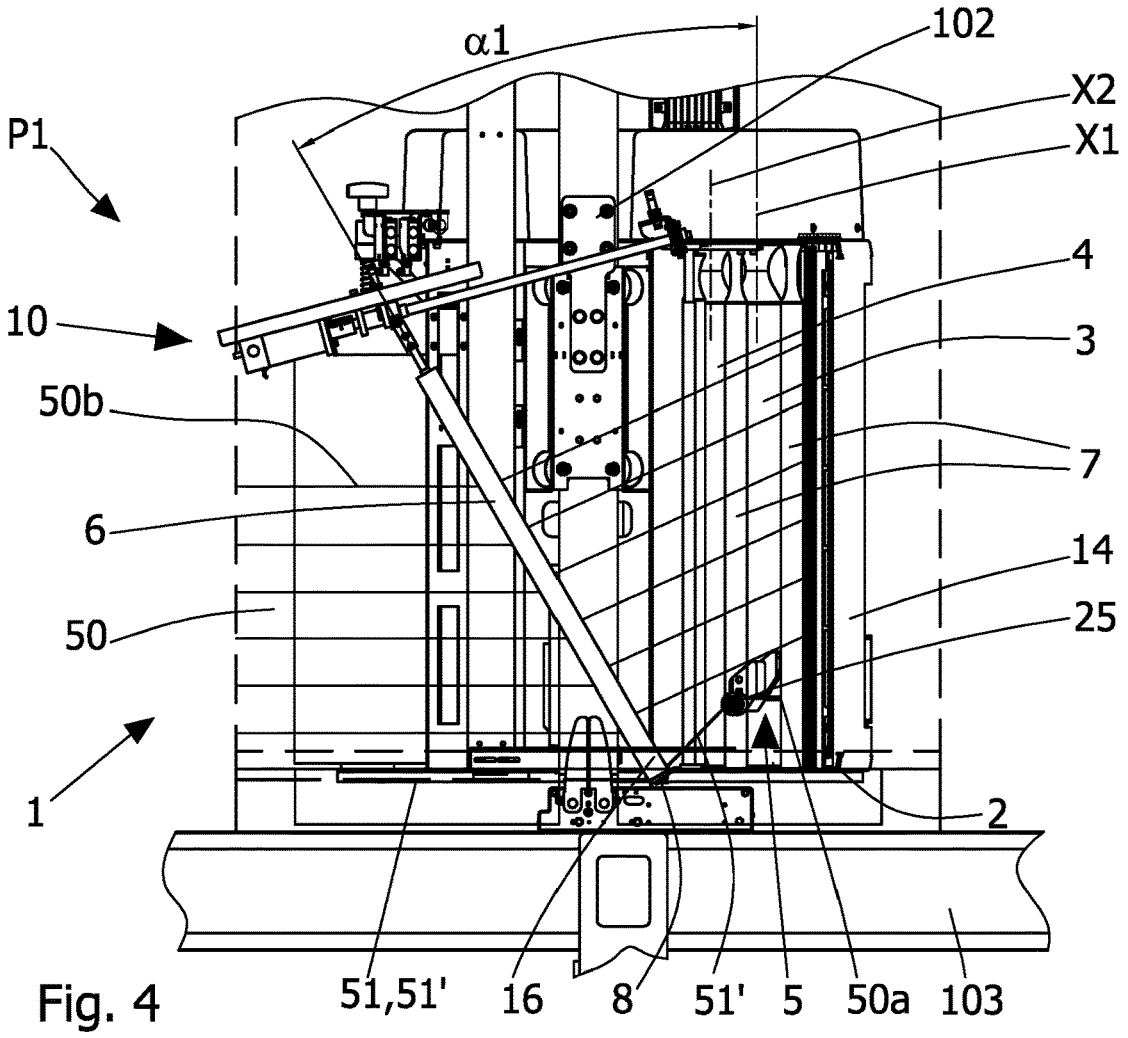
Fig. 4

Fig. 7
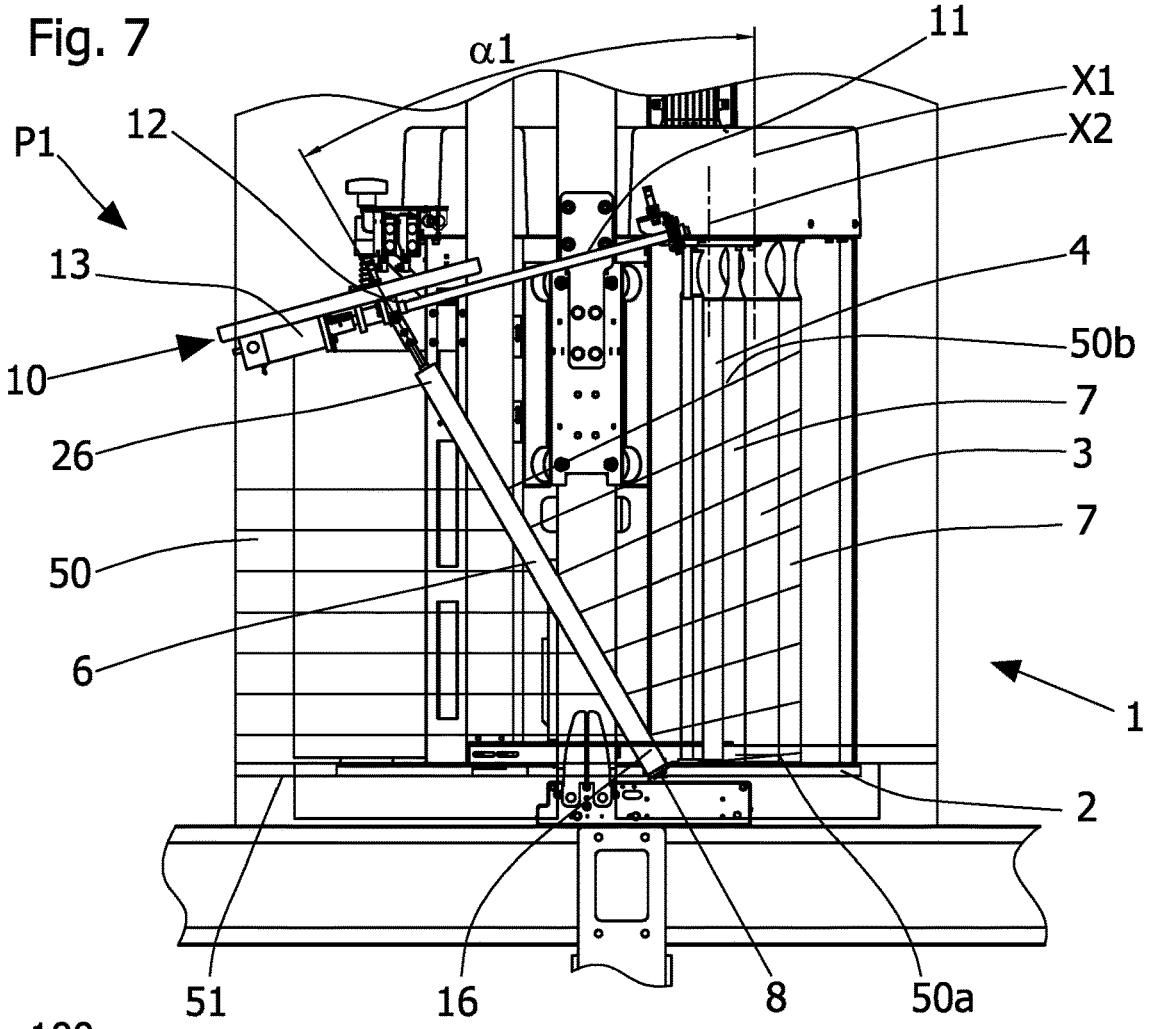
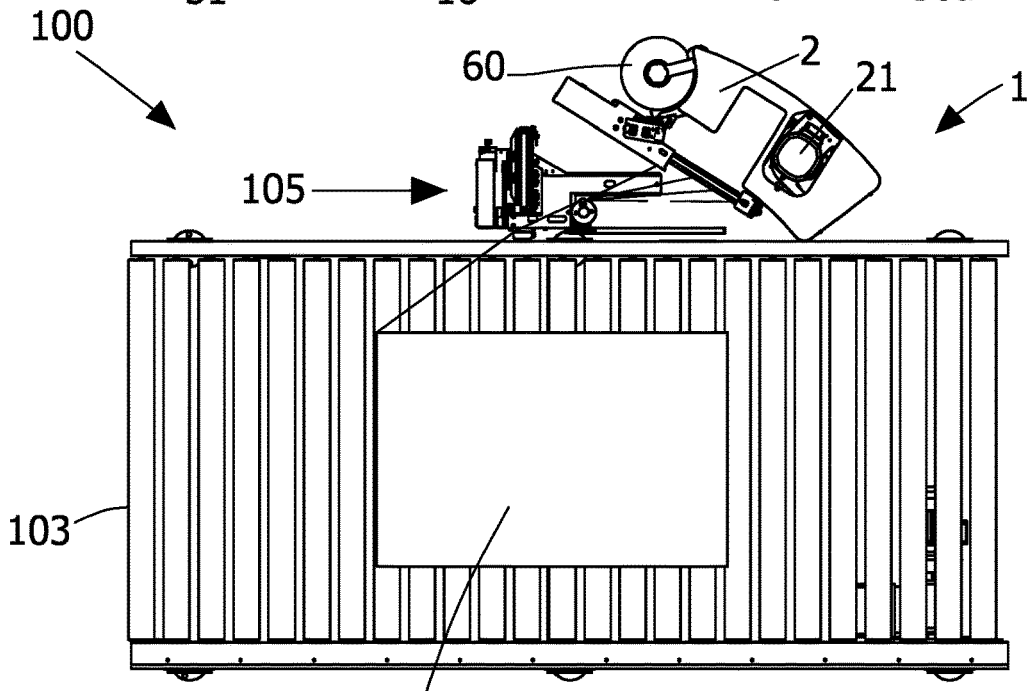
Fig. 10

UNWINDING APPARATUS FOR WRAPPING MACHINE

The invention relates to apparatuses and machines for wrapping products with an extendable plastic film, and in particular it relates to an unwinding apparatus installable on a wrapping machine for unwinding, pre-stretching, selectively narrowing a band width of the film and deviating or directing the film towards a load to be wrapped. The latter generally consists of a product or a group of products, typically arranged overlapping on a pallet to form a so-called palletized load.

Unwinding apparatuses mounted on wrapping machines supporting a film reel from which the plastic film is unwound to be wrapped around the load so as to form a series of helix braided bands or strips, thanks to the combination of the vertical movement of the unwinding apparatus and the relative rotation between the latter and the load, are known. In particular, the unwinding apparatus and the load placed on the pallet rotate relative to each other with respect to a wrapping axis.

In wrapping machines equipped with a rotary table to support the load, the latter is rotated about a vertical wrapping axis, while the wrapping apparatus is moved vertically with alternating motion along a fixed column of the machine.

In ring or rotating arm wrapping machines, the load remains fixed during wrapping, while the unwinding apparatus, fixed to the ring or the rotating arm, is moved with respect to the latter both in rotation about and in translation parallel to the vertical wrapping axis.

The wrapping apparatus typically comprises a carriage that supports, in addition to the film reel, a pair of pre-stretching rollers arranged to unwind the film from the reel and pre-stretch or lengthen it, and one or more return rollers to deviate the film towards the load. By appropriately adjusting the difference between the rotational speeds of the pre-stretching rollers it is possible to pre-stretch the film by a defined amount or percentage and/or vary the unwinding speed of the film from the reel.

The plastic film is wrapped to completely wrap the load on all its sides. To stabilize the load when it is placed on a pallet it is also necessary to wrap the film around an upper portion of the pallet. If this is not done, the load could dangerously move relative to the latter during wrapping and/or subsequent transport.

In order to ensure adequate tension to the film and to ensure greater resistance to tensile forces caused, for example, by displacements or movements of the load, the film may advantageously be completely or partially wound in such a way as to reduce a band or strip width and at the same time create a film rope to be wrapped tightly around the load and in particular around an upper portion of the pallet. The rope, which is obtained by gradually wrapping or rolling a longitudinal edge of the film, allows a greater wrapping or pulling force than the full-band or full-strip film.

In order to wrap the film, in whole band or partially or totally rolled in a rope, around the upper portion of the pallet, in particular on the wrapping machines with rotating arm and on those with a rotating ring, suitable lifting means are provided capable of lifting the load to a height such that the film can also be wrapped around the upper portion of the pallet. The lifting means are inserted and associated with the conveyor that supports the load during the wrapping and allows it to be moved in and out of the machine.

Alternatively, unwinding devices are known that are mounted on the rotating arms or on the rotating rings of the machines so that they can be rotated, in particular oriented or tilted downwards so as to direct the film towards the upper portion of the pallet to be wrapped.

However, these known solutions have the disadvantage that they are quite complex and in any case expensive to be installed on wrapping machines.

WO2012/153285 discloses an unwinding apparatus associable with a machine for wrapping a load with a plastic film that includes a support element adapted to support a film reel, a set of rollers adapted to unwind and pre-roll the film, and a guiding roller capable of engaging and deviating the film leaving the rollers towards the load. The guiding roller is pivotally mounted on the support element so as to be tiltable by a defined tilting angle with respect to the rotation axes of the rollers to reduce a band width of the film wrapped around the load.

It is an object of the invention to improve the known unwinding apparatuses associable with wrapping machines and arranged to unwind, pre-stretch and narrow a band width of a plastic film to be wrapped around a load supported by a pallet.

Another object is to obtain an unwinding apparatus that allows to effectively and tightly wrap a load base to the pallet to optimally stabilize the aforementioned load.

A further object is to obtain an unwinding apparatus that allows a band width or width of the plastic film to be varied in a simple, rapid and effective manner during its wrapping around the load.

Still another object is to create an unwinding apparatus having simple and cost-effective construction.

These and further objects are achieved by an unwinding apparatus according to one or more of the claims set out below.

The invention can be better understood and implemented with reference to the attached drawings which illustrate some exemplifying and non-limiting embodiments thereof, wherein:

FIG. 3 is a plan view of the unwinding apparatus and the wrapping machine of FIG. 1;

FIG. 4 is an enlarged view of the unwinding apparatus of FIG. 1;

FIG. 7 is an enlarged view of the unwinding apparatus of FIG. 5;

FIG. 10 is a top plan view of the unwinding apparatus and the wrapping machine of FIG. 8;

Figure 1:
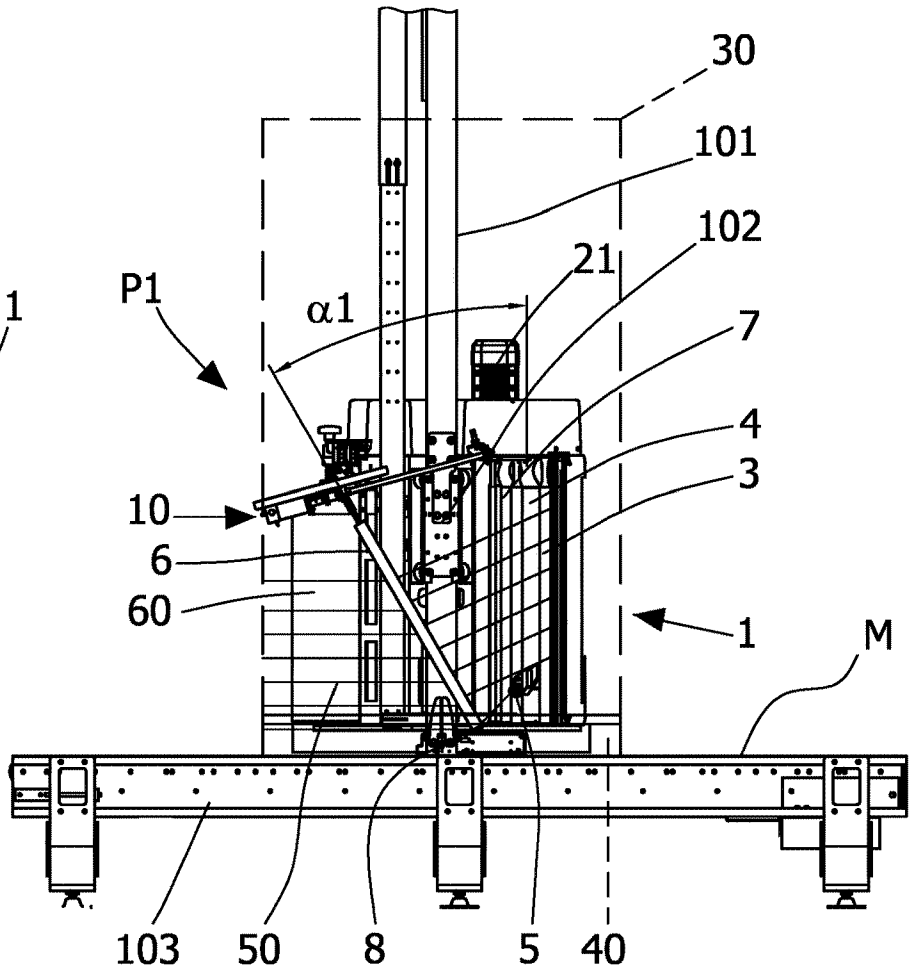
FIG. 1 is a front view of the unwinding apparatus associated with a wrapping machine, partially illustrated, and a load on a pallet, in an operating configuration.
Figure 2:
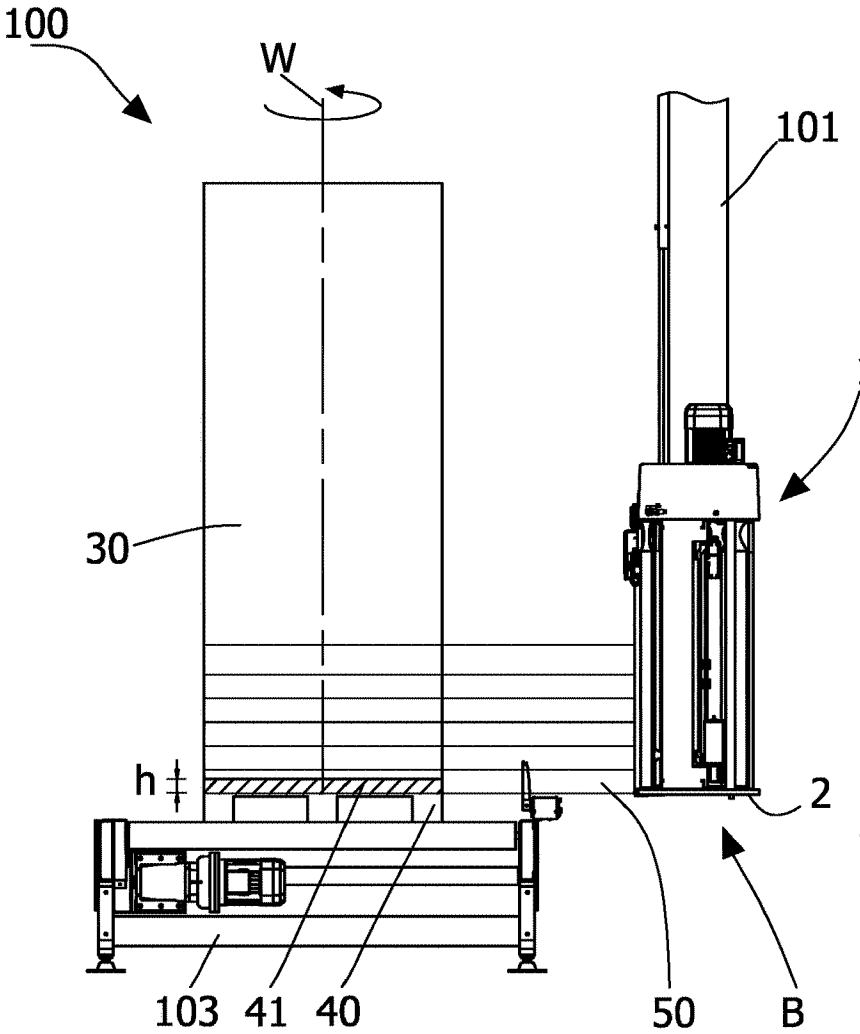
FIG. 2 is a side view of the unwinding apparatus and the wrapping machine of FIG. 1.

With reference to FIGS. 1 to 15, an unwinding apparatus 1 is illustrated, associable with a wrapping machine 100 for wrapping a load 30 that includes, for example, a plurality of products arranged on a pallet 40 to form a palletized load, with a film 50 of extendable plastic material, having height or width L.

The wrapping machine 100 is, for example, a machine of the rotating arm type, known and therefore partially illustrated and described, provided in particular with a vertical arm 101 rotating about a vertical wrapping axis W and with vertical moving means 102 to support and move the unwinding apparatus 1 along the vertical arm 101 that is along a direction parallel to the wrapping axis W. The load 30 arranged on the pallet 40 is positioned on a roller conveyor or roller 103 of the wrapping machine 100, said conveyor being able to move the load 30 with the pallet 40 in and out of the wrapping machine 100 itself.

It is to be noted that the wrapping apparatus 1 of the invention can also be mounted on a horizontal rotating ring type wrapping machine, or on a rotating platform and vertical support column wrapping machine.

The unwinding apparatus 1 comprises supporting means 2 for supporting a reel 60 of the film 50, roller means 3, 4, 7 arranged to unwind and pre-stretch the film 50, and a guiding roller 6 for engaging and deviating towards the load 30 the film 50 leaving the roller means 3, 4, 7. The guiding roller 6 is rotatably mounted on the supporting means 2 so as to be tiltable with respect to longitudinal rotating axes X1, X2 of the roller means 3, 4, 7 so as to reduce a band width of the film 50 wrapped around the load 30 and/or deviate the film 50 itself towards a supporting plane M adapted to support said load 30 and said pallet 40 during the operation of the wrapping machine 100.

The roller means 3, 4, 7 comprise a first pre-stretching roller 3 and a second pre-stretching roller 4 cooperating to unwind and pre-stretch the film 50. The pre-stretching rollers 3, 4 are rotated about respective longitudinal axes X1, X2, for example, by an electric motor 21 and a motion reduction and transmission assembly, or alternatively by respective electric motors.

The first pre-stretching roller 3, called the fast roller, which is located downstream of the second pre-stretching roller 4, called the slow roller, with respect to the movement of the film 50, rotates about the respective longitudinal rotation axis X1 faster than the second pre-stretching roller 4 (rotatable about the respective rotation axis X2) so as to pre-stretch the film 50 by a defined amount or percentage. The roller means further include a plurality of return rollers 7, parallel to the pre-stretching rollers 3, 4 and arranged to deviate the film 50 from the reel 60 towards the first pre-stretching roller 3 and the second pre-stretching roller 4 and from the latter towards the guiding roller 6.

The unwinding apparatus 1 further comprises driving means 10 for tilting the guiding roller 6 with respect to the roller means 3, 4, 7 continuously in a plurality (theoretically infinite) of different operating positions along an adjustment stroke that is comprised between an initial operating position P0, in which the guiding roller 6 is substantially parallel to the longitudinal rotating axes X1, X2 of the roller means 3, 4, 7 i.e. forms with said longitudinal rotating axes X1, X2 a tilting angle equal to 0°, and a first operating position P1, in which said guiding roller 6 is tilted by a first tilting angle α1 with respect to the longitudinal rotating axes X1, X2.

In the initial operating position P0 the guiding roller 6 is parallel to the pre-stretching rollers 3, 4, and the return rollers 7 and does not reduce a band width of said film 50 or deviate the latter towards the supporting plane M.

In the first operating position P1 the guiding roller 6 is tilted by a first angle α1 with respect to the longitudinal rotating axes X1, X2 to reduce the band width of the film 50 and/or deviate it towards the support plane M on the load 30 and also on an upper portion 41 of the pallet 40, when the unwinding apparatus 1 is arranged in a lowered position B in which it is closer to the supporting plane M. The first tilting angle α1 is such as to allow to wrap an upper portion 41 of the pallet 40 having a height h between 40 and 60 mm, in particular equal to about 50 mm, with the film 50. This wrapping height, or width, h, of the upper portion 41 of the pallet 40 allows, as demonstrated by numerous tests performed by the applicant, to secure the load 30 firmly to the pallet 40 to ensure greater resistance to tensile forces caused, for example, by displacements or movements of the load (FIGS. 1-4).

The first tilting angle α1, in particular, is determined based on the type of wrapping machine 100, the distance of the unwinding apparatus 1 from the load 40, the dimensions and position of the latter with respect to the wrapping axis W, the physical characteristics of the wrapping film 50, the pre-stretch percentage and the wrapping tension applied to the film 50.

In the illustrated embodiment, the first angle α1 is, for example, between 25° and 50°, in particular about 30°.

The guiding roller 6 includes a first end portion 16 rotatably connected to the supporting means 2 and an opposite second end portion 26 on which the first driving means 10 act.

More precisely, the first end portion 16 of the guiding roller 6 is mounted on a support element 15 that is rotatably fixed to the supporting means 2. The support element 15 is rotatable around a transverse axis Y, in particular orthogonal, to a longitudinal axis X of the guiding roller 6 and substantially parallel to the supporting plane M. The first end portion 16, i.e. the guiding roller 6, is mounted neutrally on the support element 15 that is free to rotate around the longitudinal axis X.

The first end portion 16 is provided with a roll 8, coaxial and rotatable with the guiding roller 6, and provided with a groove 8*a* able to abut and partially roll up a longitudinal lower edge 50*a* of the film 50 leaving the roller means 3, when the guiding roller 6 is tilted, in particular by the first angle α1, so as to realize a longitudinal rolled portion 51.

Figure 5:
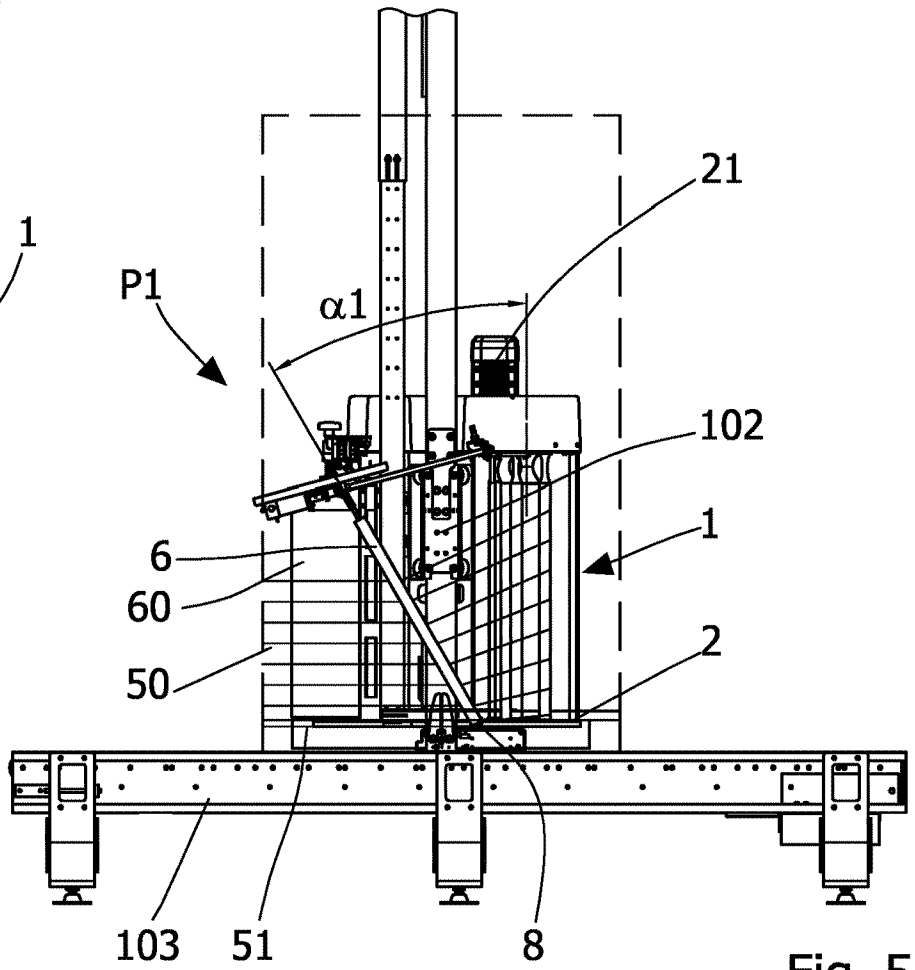
FIGS. 5 and 6 are front and side views of the unwinding apparatus associated with the wrapping machine and in a further operating configuration, respectively.
Figure 6:
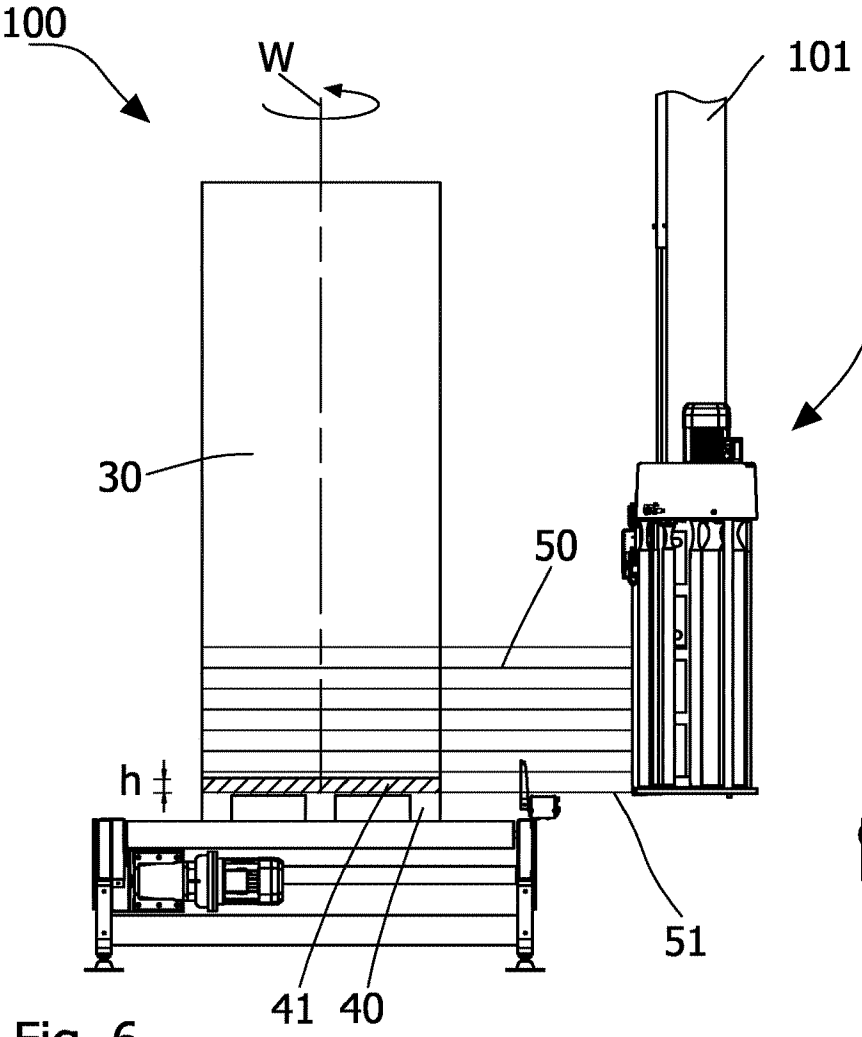

More precisely, and as better explained in the following description, it has been surprisingly verified, after numerous tests carried out by the applicant, that tilting the guiding roller 6, provided on the first end portion 16 of the roll 8, in particular by the first angle α1, it is possible to wrap the load 30, and also the upper portion 41 of the pallet 40, with a film 50 in which the longitudinal lower edge 50*a* is partially rolled so as to form a longitudinal rolled portion 51 capable of conferring greater resistance to the film 50 in the wrapping. In fact, it occurs that, while leaving the roller means 3, 4, 7 the longitudinal lower edge 50*a* of the film 50 abuts the roll 8 and, besides being deviated, is also partially rolled thanks to the groove 8*a* (FIGS. 5-7).

The unwinding apparatus 1 may also comprise folding means 5 interposed between the roller means 3, 4, 7 and the guiding roller 6, movable and selectively activable to abut and roll at least the longitudinal lower edge 50*a* of the film 50 leaving the roller means 3, 4, 7 and realize a further longitudinal rolled portion 51, the latter having larger dimensions than the longitudinal rolled portion 51 achievable with the roll 8 of the guiding roller 6.

Thus, in one of the operating positions P1, P2 of the guiding roller 6, the latter is able to deviate the film 50 optionally provided with the longitudinal rolled portion 51 made by the roll 8, in particular with the guiding roller in the first operating position P1, and/or the further longitudinal rolled portion 51' made by appropriately activating and moving the folding means 5, towards the load 30 and possibly also on the upper portion 41 of the pallet 40.

In a variant of the unwinding apparatus 1 of the invention not illustrated in the figures, the folding means 5 interposed between the roller means 3, 4, 7 and the guiding roller 6 may be configured to abut and roll an upper longitudinal edge 50*b* of the film 50 and form an upper longitudinal rolled portion or be configured to abut both the upper longitudinal edge 50*b* and the longitudinal lower edge 50*a* of the film 50 and form the upper longitudinal rolled portion and the further lower rolled portion 51'.

Figure 14:
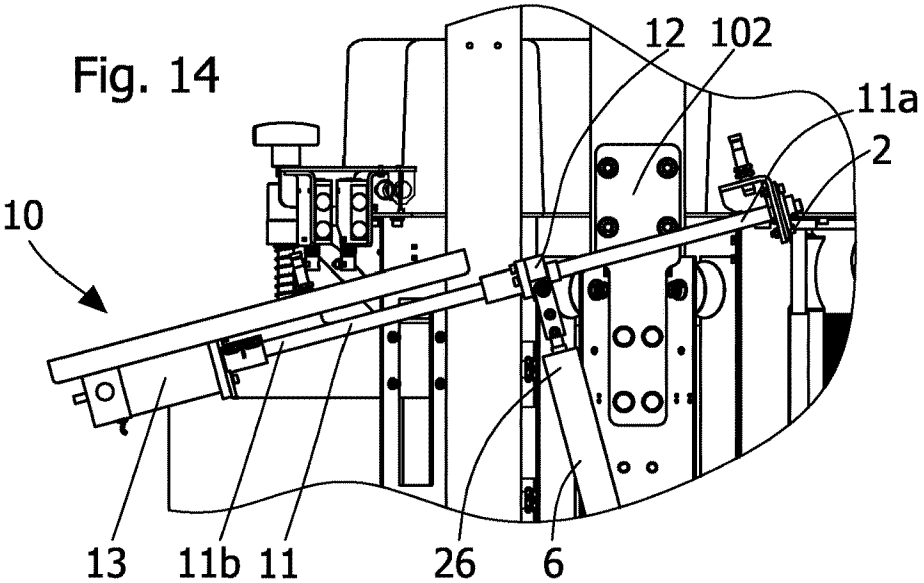
FIG. 14 is an enlarged detail of FIG. 13 illustrating in particular first driving means of a guiding roller of the unwinding apparatus of the invention.
Figure 15:
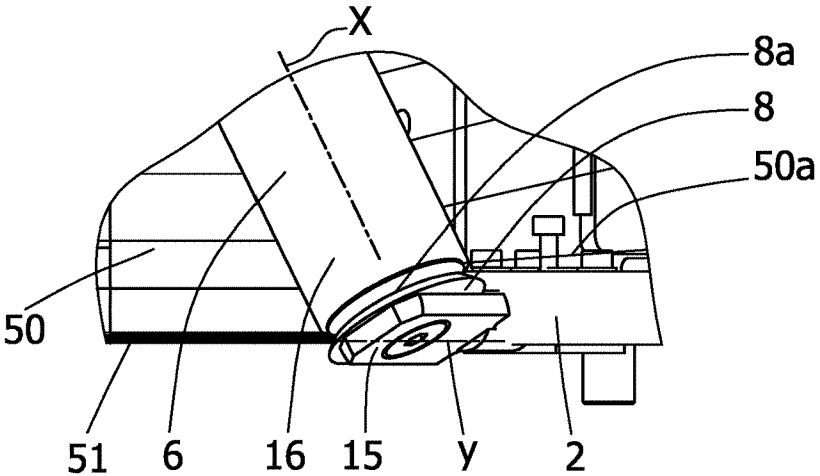
FIG. 15 shows an enlarged detail of FIG. 10 showing in particular a first end portion of the guiding roller connected to supporting means and equipped with a roll.

With particular reference to FIG. 4, the folding means 5 comprise in the illustrated embodiment a folding element 25 interposed between the roller means 3, 4, 7 and the guiding roller 6 and selectively movable by second driving means 14, of known type, along a narrowing trajectory so as to abut the longitudinal lower edge 50*a* of the film 50 and push it towards the upper longitudinal edge 50*b* of the film 50 so as to reduce a band width and at the same time create a longitudinal rolled portion 51' of the film 50 in the form of a rope. With particular reference to FIG. 14, the first driving means 10 comprise a linear actuator, of an electrical or pneumatic type, connected to the supporting means 2 and acting on the second end portion 26 of the guiding roller 6.

In the illustrated embodiment the first driving means 10 comprise, for example, a screw 11 and a nut screw 12. The screw 11 has a first end 11*a* rotatably connected to the supporting means 2 and an opposite second end 11*b* rotated about a respective longitudinal axis by motor means 13. The nut screw 12 is engaged with the screw 11 so as to move along the latter when the screw 11 is rotated by the motor means 13. The nut screw 12 is pivotally connected to the second end portion 26 of the guiding roller 6. The motor means 13 comprise an electric motor with integrated gear reducer.

The operation of the wrapping apparatus 1 of the invention, associated by way of example with the wrapping machine 100 with a rotating arm, provides for the rotation of said unwinding apparatus 1 slidably connected to the vertical arm 101 around the wrapping axis W and the rotation of the pre-stretching rollers 3, 4 to unwind the film 50 from the reel 60 and pre-stretch it by a fixed amount or percentage.

Figure 11:
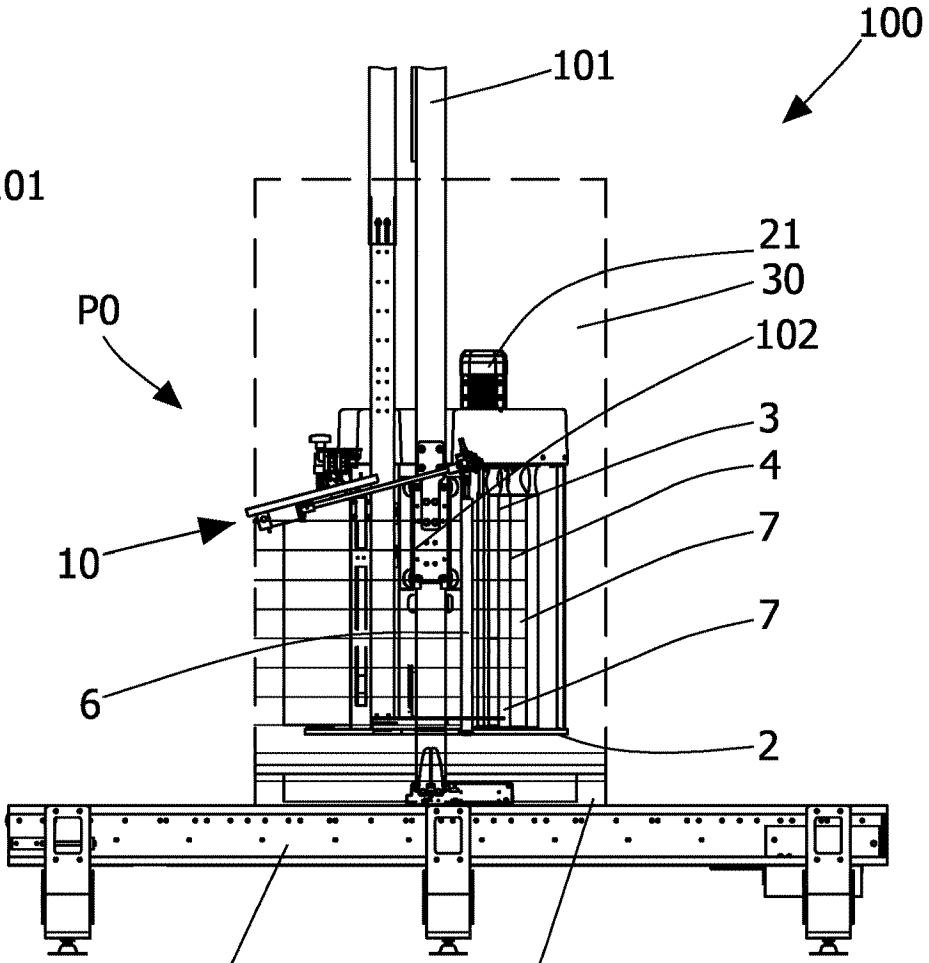
FIGS. 11 and 12 are respectively front and side views of the unwinding apparatus in a phase of a wrapping cycle of the wrapping machine.
Figure 12:
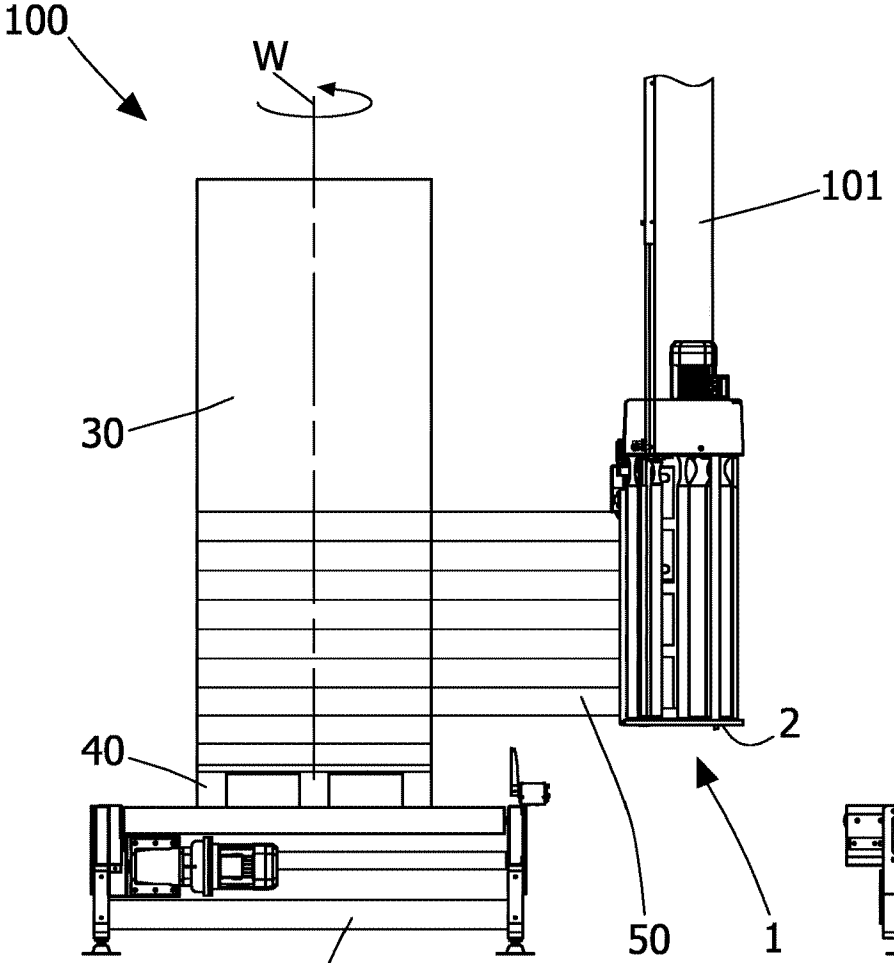

At an initial stage of the wrapping cycle, the guiding roller 6 can be arranged in an initial operating position P0 in which it is parallel to the pre-stretching rollers 3, 4, i.e. it forms the initial tilting angle $\alpha 0$ substantially equal to 0° and in which the guiding roller 6 engages the film 50 without causing any narrowing or diversion towards the supporting plane M (FIGS. 11 and 12). In this initial operating position P0, an width or height of the band or strip of film 50 wrapping the load 30 is substantially the same as the height or width L of the film 50 wrapped on the reel 60, i.e., the height of the reel 60 itself.

To stabilize the load 30, i.e. to wrap it more firmly, the guiding roller 6 may be tilted, in particular by the first angle $\alpha 1$ in the first operating position P1 so as to roll up the longitudinal lower edge 50*a* of the film 50 by the roll 8 provided with the groove 8*a* and realize the longitudinal rolled portion 51 in the form of a rope that allows for greater tensile strength of the film and obtaining a greater wrapping or pulling force on the load or pallet.

Alternatively or additionally, the folding means 5 may be actuated to allow the folding element 25 to abut and roll the longitudinal lower edge 50*a* of the film 50 leaving the roller means 3, 4, 7 and realize the further longitudinal rolled portion 51'. In other words, the longitudinal lower edge 50*a* may be rolled by the roller 8 of the guiding roller 6, in particular in the first operating position P1, or by the folding means 5 or by the latter and the roll 8. It is noted that the longitudinal lower edge 50*a* of the film 50 may be wound in the form of a rope at any position of the unwinding apparatus 1 along the vertical arm 101.

In particular, in the lowered position B of the unwinding apparatus 1, the guiding roller, if tilted by the first driving means 10 by the first angle $\alpha 1$ in the first operating position P1, is able to deviate the film 50 towards the load 30 and towards the upper portion 41 of the pallet 40 to secure the load 30 more firmly to the latter. In this configuration, the guiding roller 6 deviates towards the upper portion 41 of the pallet 40 the longitudinal rolled portion 51 of the film 50 made by the roller 8 so as to wrap the upper portion 41 of the pallet 40 with a plurality of turns (FIGS. 1-6).

Note that due to the longitudinal rolled portion 51 and the tilting of the guiding roller 6 the band width of the wrapped film on the load and on the upper portion 41 of the pallet 40 is significantly less than the height or width L of the film 50 leaving the reel 60.

After a predetermined number of wrapping turns, the folding means 5, if used to roll the longitudinal lower edge 50*a* of the film 50, are actuated so as to disengage the folding element 25 from the film 50 and the guiding roller 6 is repositioned from the first driving means 10 to the initial operating position P0 with an initial tilting angle $\alpha 0$ substantially 0° to allow the wrapping of the load 30 to be completed.

Alternatively, the guiding roller 6 may be tilted in one of a plurality of second operating positions P2 of a respective second tilting angle $\alpha 2$ to reduce the film band width in order to wrap a load having a height less than the height L of the reel 60 without the need to replace the latter.

Figure 8:
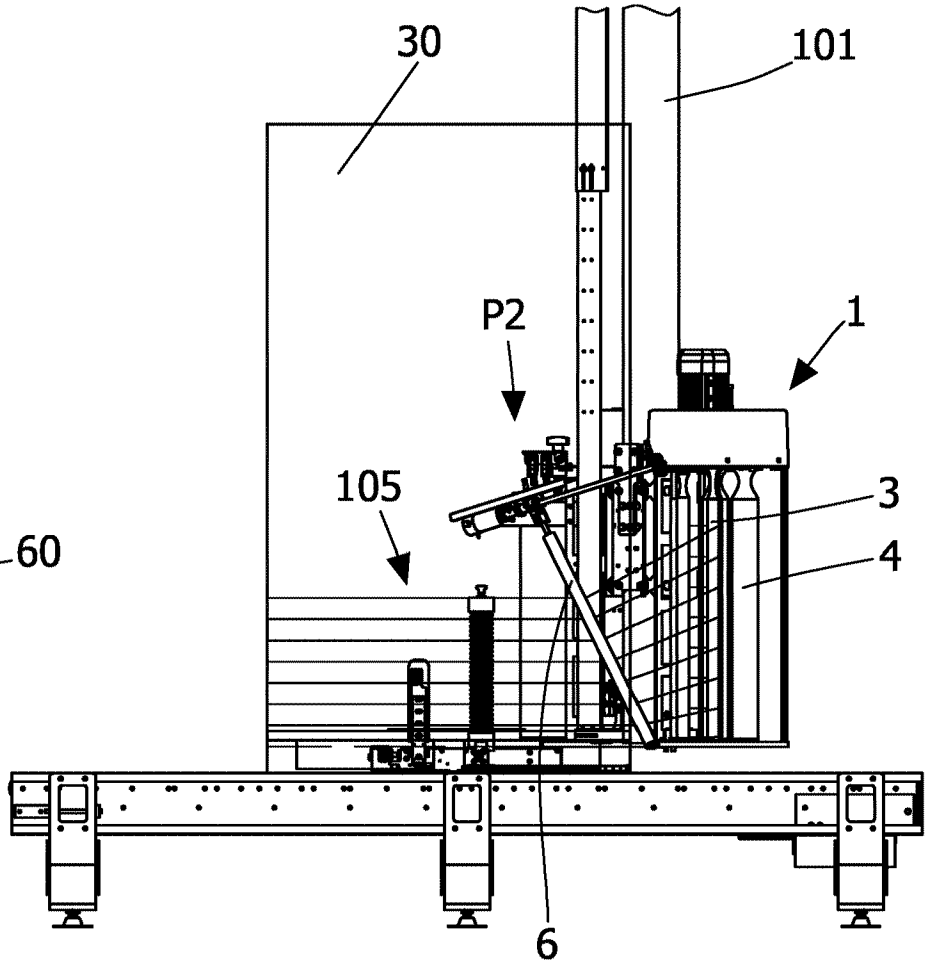
FIGS. 8 and 9 are front and side views, respectively, of the unwinding apparatus in the first operating configuration in a final phase of a wrapping cycle of the wrapping machine.
Figure 9:
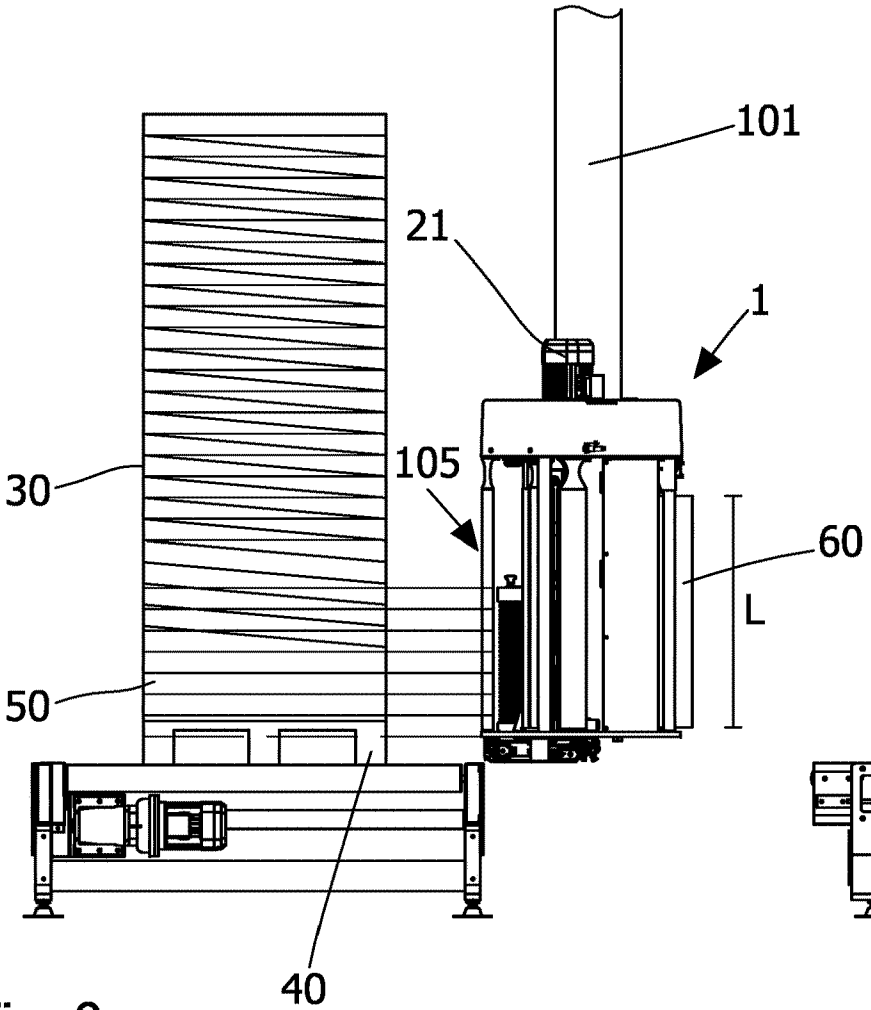
Figure 13:
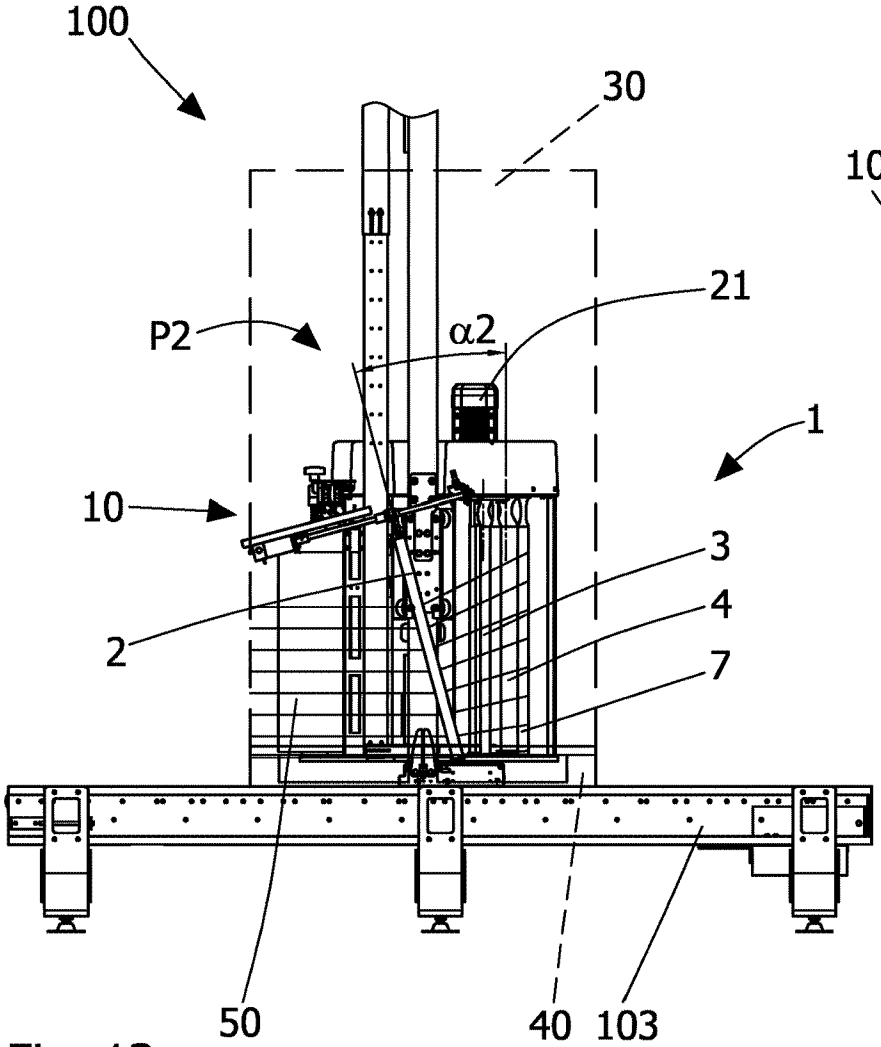
FIG. 13 is a front view of the unwinding apparatus associated with the wrapping machine, partially illustrated, in another operating configuration.

At the end of the wrapping, the guiding roller 6 may be tilted in another of a plurality of second operating positions P2 by a respective second tilting angle $\alpha 2$ to reduce the film band width, for example to use gripping, cutting and welding means 105 of the wrapping machine 100 having reduced height and dimensions (FIGS. 8, 9 and 13).

The second operating positions P2 are therefore intermediate operating positions since the respective second tilting angles $\alpha 2$ are between the initial tilting angle $\alpha 0$ (equal to 0°) and the first tilting angle $\alpha 1$ (for example equal to 30°).

As discussed above, the value of the second angle $\alpha 2$ (i.e., the value of the reduction of the film band width) can then be determined from the height L of the film 50 leaving the reel 60, from a height of the load 40 to be wrapped, or from the dimensions of the gripping, cutting and welding means 105 of the wrapping machine 100.

Thanks to the unwinding apparatus 1 of the invention it is therefore possible to effectively and tightly wrap a load base 30 to the underlying pallet 40 to optimally stabilize said load 30 without using specific lifting means of the latter and/or without requiring rotation or tilting of the unwinding apparatus with respect to the support arm 101.

It is also possible to easily, quickly and effectively vary a band width or width of the plastic film during its wrapping around the load and in particular vary it by a desired amount according to the specific needs, being able to position the guiding roller in a plurality of second operating positions P2.

It should be noted, in fact, that thanks to the first driving means 10 that allow to move and in particular tilt the guiding roller 6 continuously in a plurality (theoretically infinite) of different operating positions along the adjustment stroke, it is possible to position the guiding roller 6 rapidly and quickly, in addition to the first initial position P0 (without deviating or reducing the film band width) and the first operating position P1 (to reduce and deviate the film on the load 30 and on the upper portion 41 of the pallet 40), in a plurality of second operating positions P2 to reduce the film band width by the desired amounts according to specific needs.

It should also be noted that the operating positions P1, P2, and in particular the first operating position P1, of the guiding roller 6 depend on a plurality of highly variable operating parameters and conditions, such as distance of the unwinding apparatus 1 from the load 40, dimensions and position of the latter with respect to the wrapping axis W, characteristics of the film 50 (pre-stretch percentage and wrapping tension), but can be quickly and precisely identified in the unwinding apparatus 1 of the invention thanks to the first moving means 10.

Finally, it should be noted that the unwinding apparatus 1 of the invention also allows to choose the type of cording to be applied to the base of the load 30 and/or to the upper portion 41 of the pallet 40 to optimally stabilize the load 30. More precisely, for a firmer and more resistant wrapping, the folding means 5 can be used capable of abutting and rolling up a longitudinal lower edge 50*a* of the film 50 and creating a further longitudinal rolled portion 51' on the film 50 having desired dimensions and therefore more or less resistant.

Alternatively, in the case, for example, of lighter load or of limited size, the folding means 5 may not be used, since the coaxial and rotatable roll 8 with the guiding roller 6 and provided with a groove 8*a* allows to realize a longitudinal rolled portion 51 having smaller dimensions than the further longitudinal rolled portion 51' achievable with the folding means 5, but still able to confer greater resistance to the film.

Alternatively, both the folding means 5 and the roll 8 of the guiding roller 6 may be used to abut and roll up the longitudinal lower edge 50*a* of the film 50.

The unwinding apparatus 1 thanks to the use of the first driving means 10 comprising a screw-nut screw linear actuator also has a simple and cost-effective construction.

The invention claimed is:

1. An unwinding apparatus associable with a wrapping machine for wrapping with a film of plastic material a load positioned on a pallet, the unwinding apparatus comprising:

a supporting arrangement for supporting a reel of the film;

a roller assembly fixed to said supporting arrangement and arranged for unwinding and pre-stretching the film;

a guiding roller for engaging and deviating towards the load the film leaving said roller assembly, said guiding roller being rotatably mounted on said supporting arrangement so as to be tiltable with respect to longitudinal rotating axes of said roller assembly, so as to reduce a band width of the film wrapped around the load and/or deviate the film towards the load and a supporting plane adapted to support the load; and a first driving device for tilting said guiding roller, wherein said first driving device is configured to tilt said guiding roller continuously in a plurality of different operating positions along an adjustment stroke between an initial operating position, in which said guiding roller is substantially parallel to the longitudinal rotating axes and does not reduce a band width of the film nor deviate the film towards the supporting plane, and a first operating position in which said guiding roller is tilted by a first angle with respect to the longitudinal rotating axes to reduce the band width of the film and/or deviate the film towards the supporting plane and the load, said guiding roller comprises a first end portion rotatably connected to said supporting arrangement and provided with a roll, coaxial and rotatable with said guiding roller and provided with a groove able to abut and partially roll up a longitudinal lower edge of the film leaving said roller assembly when said guiding roller is tilted so as to form a longitudinal rolled portion, the groove of the roll has a rounded bottom surface, and an external cylindrical surface of the guiding roller is continuously smooth from the groove to a second end portion of the guiding roller.

2. The unwinding apparatus according to claim 1, wherein in a lowered position of the unwinding apparatus, in which the unwinding apparatus is closer to the supporting plane, said guiding roller tilted in the first operating position is arranged to deviate the film towards the load and/or towards an upper portion of the pallet.

3. The unwinding apparatus according to claim 2, wherein the first angle is between 25° and 50°.

4. The unwinding apparatus according to claim 1, further comprising a folding system interposed between said roller assembly and said guiding roller, said folding system being movable and selectively activable in order to abut and roll up the longitudinal lower edge and/or a longitudinal upper edge of the film leaving said roller assembly and forming respective longitudinal rolled portions.

5. The unwinding apparatus according to claim 4, wherein said folding system is configured to abut and roll up the longitudinal lower edge of the film leaving said roller assembly and form a further longitudinal rolled portion on the film.

6. The unwinding apparatus according to claim 5, wherein, in a lowered position of the unwinding apparatus, in which the unwinding apparatus is closer to the supporting plane, said guiding roller in the first operating position is arranged to deviate the film provided with the longitudinal rolled portion and/or the further longitudinal rolled portion towards the load and/or towards an upper portion of the pallet.

7. The unwinding apparatus according to claim 6, wherein the first angle is between 25° and 50°.

8. The unwinding apparatus according to claim 5, wherein the first angle is between 25° and 50°.

9. The unwinding apparatus according to claim 4, wherein said folding system comprises at least one folding element interposed between said roller assembly and said guiding roller, said at least one folding element being selectively movable by a second driving device along a narrowing trajectory so as to abut the longitudinal lower edge of the film and push the longitudinal lower edge towards the longitudinal upper edge of the film to reduce a band width of the film.

10. The unwinding apparatus according to claim 4, wherein the first angle is between 25° and 50°.

11. The unwinding apparatus according to claim 1, wherein the first angle is such to allow an upper portion of the pallet having a height between 40 and 60 mm, to be wrapped with the film when the unwinding apparatus is arranged in a lowered position, in which the unwinding apparatus is closer to the supporting plane.

12. The unwinding apparatus according to claim 11, wherein the first angle is between 25° and 50°.

13. The unwinding apparatus according to claim 1, wherein the first angle is between 25° and 50°.

14. The unwinding apparatus according to claim 1, wherein said first driving device is arranged to tilt said guiding roller in a plurality of second operating positions by respective second angles to deviate and reduce by a respective amount a band width of the film wound around the load and/or the pallet.

15. The unwinding apparatus according to claim 1, wherein said first driving device comprises a linear actuator that is connected to said supporting arrangement and acts on said second end portion of said guiding roller that is opposite to said first end portion of said guiding roller which is rotatably connected to said supporting arrangement.

16. The unwinding apparatus according to claim 15, wherein said linear actuator comprises:

a screw having a first end, rotatably connected to said supporting arrangement and an opposite second end rotated about a respective longitudinal axis of said screw by a motor device; and a nut screw engaged with said screw so as to translate along said screw when said screw is rotated, said nut screw being rotatably connected to said second end portion of said guiding roller.

17. A wrapping machine for wrapping a load positioned on a pallet with a film of plastic material, the wrapping machine comprising an unwinding apparatus according to claim 1.

18. A wrapping machine according to claim 17, further comprising a moving assembly to support and move said unwinding apparatus at least along a direction parallel to a wrapping axis about which said unwinding apparatus and the load on the pallet rotate around to each other.

* * * * *